US005676208A

United States Patent [19]

Finley

[11] Patent Number: 5,676,208

[45] Date of Patent: Oct. 14, 1997

[54] APPARATUS AND METHODS OF PREVENTING SCREEN COLLAPSE IN GRAVEL PACKING OPERATIONS

[75] Inventor: Ronnie Dearl Finley, New Iberia, La.

[73] Assignee: Halliburton Company, Dallas, Tex.

[21] Appl. No.: 584,669

[22] Filed: Jan. 11, 1996

[51] Int. Cl.[6] ..... E21B 33/124

[52] U.S. Cl. ..... 166/278; 166/51; 166/158; 166/319; 166/332.1

[58] Field of Search ..... 166/278, 51, 387, 166/319, 158, 332.1

[56] References Cited

U.S. PATENT DOCUMENTS

| | | | |
|---|---|---|---|
| 3,710,862 | 1/1973 | Young et al. | 166/278 |
| 4,018,284 | 4/1977 | Perkins | 166/278 |
| 4,049,055 | 9/1977 | Brown | 166/278 |
| 4,846,281 | 7/1989 | Clary et al. | 166/373 |
| 4,858,691 | 8/1989 | Ilfrey et al. | 166/278 |
| 4,915,172 | 4/1990 | Donovan et al. | 166/278 |
| 5,332,038 | 7/1994 | Tapp et al. | 166/278 |
| 5,332,045 | 7/1994 | Ross et al. | 166/387 |

*Primary Examiner*—Frank Tsay

*Attorney, Agent, or Firm*—William M. Imwalle; Marlin R. Smith

[57] ABSTRACT

A gravel packing apparatus and associated method of gravel packing a subterranean well prevents screen collapse without requiring sealing engagement of a washpipe with an external seal, without requiring reliance solely on differential pressure, and without utilizing a reciprocating valve. In a preferred embodiment, a gravel packing apparatus has a tubular mandrel, a tubular housing attached to the mandrel and defining an annular space between the mandrel and housing, a sleeve slidably disposed on the mandrel and extending into the annular space, first and second seals disposed on the sleeve, and a screen slidably disposed on the mandrel and attached to the sleeve for sliding displacement therewith.

41 Claims, 5 Drawing Sheets

APPARATUS AND METHODS OF PREVENTING SCREEN COLLAPSE IN GRAVEL PACKING OPERATIONS

BACKGROUND OF THE INVENTION

The present invention relates generally to apparatus and methods for use in gravel packing operations in subterranean wells and, in a preferred embodiment thereof, more particularly provides apparatus and methods of preventing collapse of sand control screens in such gravel packing operations.

In the course of completing an oil and/or gas well, it is common practice to run a string of protective casing into the wellbore and then to run production tubing inside the casing. At the wellsite, the casing is perforated across one or more production zones to allow production fluids to enter the wellbore. During production of the formation fluids, formation sand is oftentimes swept into the flow path of the fluids. The formation sand is typically relatively fine sand that tends to erode production equipment through which it flows.

To prevent production equipment erosion, one or more sand screens are typically installed in the flow path between the production tubing and the perforated casing. A packer is customarily set above the sand screen to seal off the annulus in the zone where production fluids flow into the production tubing. In the past, it was usual practice to install the sand screens in the well after the well had been perforated and the guns either removed from the wellbore or dropped to the bottom of the well. It is now quite common for the perforating guns and sand screens to be run in the well together.

After the sand control screens have been installed in the well, fracturing and/or gravel packing operations may be performed in order to enhance the production capabilities of the well. The term "fracturing" describes various methods of artificially increasing a characteristic of potentially productive zones known to those skilled in the art as permeability. The term "gravel packing" describes various methods of preventing the migration of formation sand into the wellbore as the well is produced. Fracturing and gravel packing operations are many times performed utilizing the same equipment in the wellbore.

Where sand control screens have been installed in the well, the gravel packing operations typically involve the placement and packing of "gravel" (i.e., relatively large grain sand, glass spheres, polymer spheres, etc.) in the annular space between the exterior of the sand screens and the interior of the casing. The produced formation sand "bridges off" as it flows through the gravel pack, thereby preventing further production of formation sand.

During gravel packing operations, the gravel is typically delivered to the annular space suspended in a fluid, such as a gel. The fluid and gravel, collectively known as a slurry, is pumped from the earth's surface downward through the production tubing and then through specialized gravel packing equipment which directs the slurry into the annular space between the sand control screens and the casing. The sand control screens permit the fluid portion of the slurry to enter the gravel packing equipment for circulation back to the earth's surface, but prevent the gravel from being circulated back through the gravel packing equipment. The gravel thus remains about the exterior of the sand control screens and accumulates in the annular space.

As the gravel accumulates in the annular space, it gradually covers the exterior of the sand control screens, restricting the flow therethrough of the slurry fluid portion. It will be readily appreciated that as flow through the sand control screens is increasingly restricted, an increasing differential pressure is created across the sand control screens. The inwardly directed differential pressure, if it is sufficiently great, will act to collapse the sand control screens.

Due to the typically hectic nature of gravel packing operations, and the typically coarse resolution of pressure indicating instruments utilized to monitor various pressures during gravel packing operations, operators at the surface usually will not be aware that sufficient differential pressure has been created to collapse the sand control screens in the wellbore. It is, therefore, not uncommon for sand control screens to be collapsed during gravel packing operations. The foregoing also applies to fracturing operations wherein a propant is delivered to the annular space suspended in a slurry.

One solution has been proposed in U.S. Pat. No. 4,428,428 to Smyrl et al., albeit in altered circumstances. Smyrl et al. discloses a differential piston sleeve installed on a washpipe inserted in the sand control screens. The washpipe is in fluid communication with a circulation flow path for the filtered slurry fluid portion and sealingly isolates an upper sand control screen from a lower sand control screen. The differential piston sleeve acts to prevent slurry fluid portion flow through the upper sand control screen until the gravel pack has covered the lower sand control screen, causing an increase in the differential pressure across the lower sand control screen and across the washpipe. When a desired differential pressure has been achieved, the differential piston sleeve displaces and uncovers auxiliary return ports through the washpipe, thereby permitting fluid portion flow through the upper sand control screen. A spring biases the differential piston sleeve to again cover the auxiliary return ports if the differential pressure should fall below a certain level.

It will be readily appreciated that if the desired differential pressure at which the differential piston sleeve displaces were selected to be somewhat less than the differential pressure required to collapse the lower sand control screen, collapse of the lower sand control screen may be prevented. There are, however, several disadvantages of utilizing the Smyrl et al. tool and method for preventing sand control screen collapse. For example, the Smyrl et al. tool and method require that the washpipe sealingly isolate the upper and lower sand control screens. Internal circumferential seals are provided intermediate the upper and lower sand control screens for this purpose. Such internal circumferential seals, which are exposed to wellbore fluids and debris before the washpipe is inserted therein, may not adequately effect a fluid seal when the washpipe is subsequently inserted therein and, if damaged, are not conveniently replaced.

Another disadvantage of the Smyrl et al. device is that it depends solely on differential pressure to displace the differential piston sleeve. Yet another disadvantage of the Smyrl et al. device is that it recloses after it has once opened, permitting differential pressure to again increase and open the ports again. The differential piston sleeve of the Smyrl et al. device, therefore, reciprocates back and forth between open and closed positions. In an abrasive wellbore environment, such continuous reciprocating motion inevitably will result in a galled or otherwise seized differential piston sleeve, frozen in an arbitrarily determined position—either open, closed, or somewhere in between. It would be far more desirable to provide a valve which remains open, instead of reciprocating between open and closed positions, for the purpose of preventing the collapse of the sand control screens.

From the foregoing, it can be seen that it would be quite desirable to provide gravel packing apparatus and associated methods of preventing collapse of sand control screens which do not require sealing engagement of a washpipe with an otherwise exposed internal seal between sand control screens, do not rely solely on differential pressure for activation thereof, and which do not have valves which reciprocate between open and closed positions, but which effectively prevent excessive differential pressure buildup across the sand control screens. It is accordingly an object of the present invention to provide such gravel packing apparatus and associated methods of gravel packing a subterranean well.

SUMMARY OF THE INVENTION

In carrying out the principles of the present invention, in accordance with an embodiment thereof, apparatus and methods are provided which prevent excess differential pressure across a sand control screen. Collapse of the sand control screen is prevented by relieving the differential pressure when it reaches a predetermined level.

In broad terms, a gravel packing apparatus operatively positionable in a subterranean well is provided which includes an axially elongated tubular mandrel, a tubular sleeve, first and second seals, and a tubular screen. The tubular mandrel has an axially extending internal flow passage formed therethrough, an external side surface, and a port permitting fluid communication between the flow passage and the external side surface. The tubular housing has an internal side surface and opposite ends. One of the housing opposite ends is sealingly attached to the mandrel external side surface, with the housing radially outwardly overlying and radially spaced apart from the mandrel. The housing thus defines an annular space radially intermediate the mandrel external side surface and the housing internal side surface.

The tubular sleeve is coaxially and slidably disposed on the mandrel. The sleeve has internal and external side surfaces and opposite ends. One of the sleeve opposite ends is radially intermediate the mandrel external side surface and the housing internal side surface and is received in the annular space. The first seal is disposed on the sleeve external side surface and sealingly engages the housing internal side surface. The second seal is disposed on the sleeve internal side surface axially spaced apart from the first seal and sealingly engages the mandrel external side surface.

The tubular screen is coaxially and slidably disposed on the mandrel. The screen is also attached to the sleeve for sliding displacement therewith relative to the mandrel.

Another gravel packing apparatus operatively positionable in a subterranean well is provided. The apparatus includes a tubular member, a tubular screen, and a tubular sleeve. The tubular member has interior and exterior side surfaces and a radially extending port formed therethrough permitting fluid communication between the tubular member interior and exterior side surfaces. The tubular screen is exteriorly and coaxially disposed relative to the tubular member. The screen radially outwardly overlies the port and has opposite ends sealingly attached to the tubular member exterior side surface with the screen opposite ends axially straddling the port.

The tubular sleeve is interiorly and coaxially disposed relative to the first tubular member. The sleeve has first and second exterior surfaces formed thereon and first and second seals disposed on the sleeve first and second exterior surfaces, respectively. The first seal sealingly engages the first tubular member interior side surface. The sleeve slidably and axially displaces from a closed position to an open position thereof.

Also provided is a method of gravel packing a subterranean well having a wellbore intersecting a formation and a packer set in the wellbore. The method includes the step of providing a tubular liner assembly having an interior bore, axially interconnected first and second elongated screens, and a valve portion, the valve portion being operative to permit flow through the first screen when a predetermined pressure differential is applied across the valve portion. The liner assembly is attached to the packer and positioned in the wellbore such that the second screen is opposite the formation.

The method also includes the step of providing a service tool string including a crossover portion and a washpipe portion. The service tool string is axially inserted into the liner assembly.

Another method of gravel packing a subterranean well having a wellbore intersecting a formation and a packer set in the wellbore is provided as well. The method includes the step of providing a tubular liner assembly having an interior bore and axially interconnected first and second elongated screens. The liner assembly is attached to the packer and positioned in the wellbore such that the second screen is opposite the formation.

The method also includes the step of providing a service tool string. The service tool string includes a crossover portion, a nonreciprocating valve portion, and a washpipe portion, the valve portion being operative to permit flow through the first screen when a predetermined pressure differential is applied across the valve portion. The service tool string is inserted axially into the liner assembly.

The use of the disclosed apparatus and methods provides more convenient and economical subterranean well completions. Specifically, the disclosed apparatus and methods prevent collapse of sand control screens due to excess differential pressure across the screens.

DETAILED DESCRIPTION

In the following detailed description of the apparatus and method embodiments of the present invention representatively illustrated in the accompanying figures, directional terms such as "upper", "lower", "upward", "downward", etc. are used in relation to the illustrated apparatus and methods as they are depicted in the accompanying figures. It is to be understood that the apparatus and methods may be utilized in vertical, horizontal, inverted, or inclined orientations without deviating from the principles of the present invention. In addition, the following detailed description of the apparatus and method embodiments of the present invention relates specifically to gravel packing operations in subterranean wells, but it is to be understood that the disclosed apparatus and methods may be utilized in other operations, such as fracturing operations, wherein it is desired to prevent excess differential pressure from collapsing items of equipment.

Figure 1A:
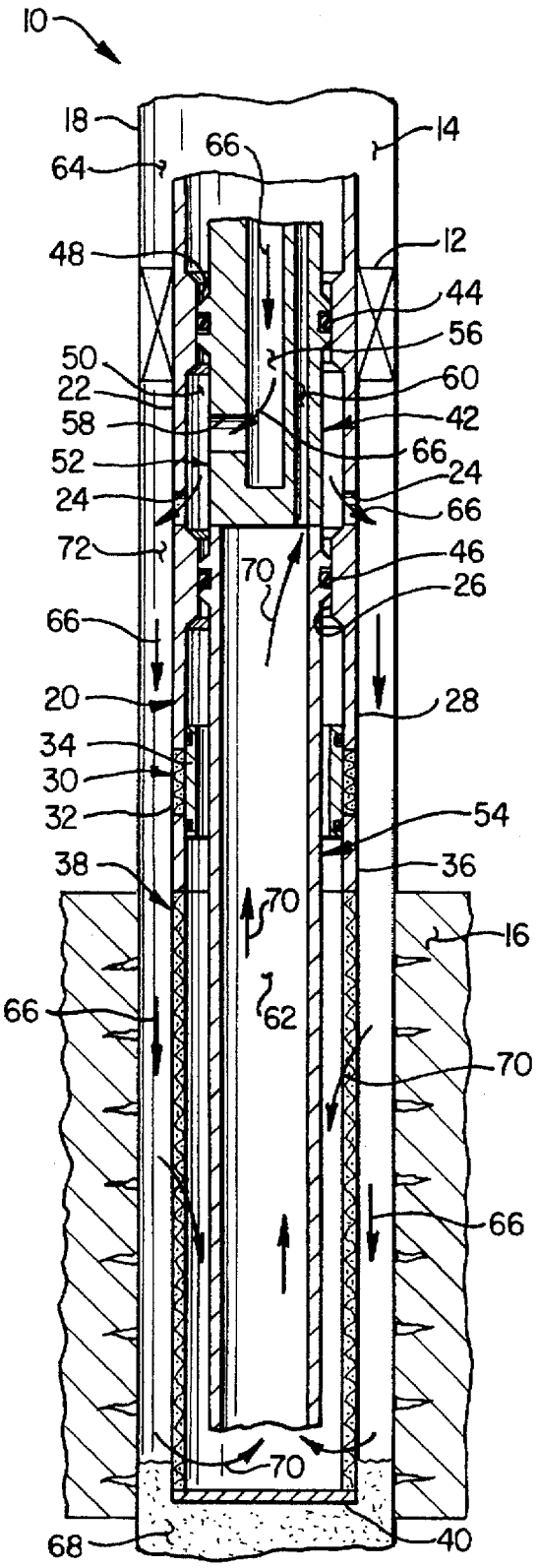
FIGS. 1A and 1B are highly schematicized cross-sectional views of a first method of gravel packing a subterranean well embodying principles of the present invention.
Figure 1B:
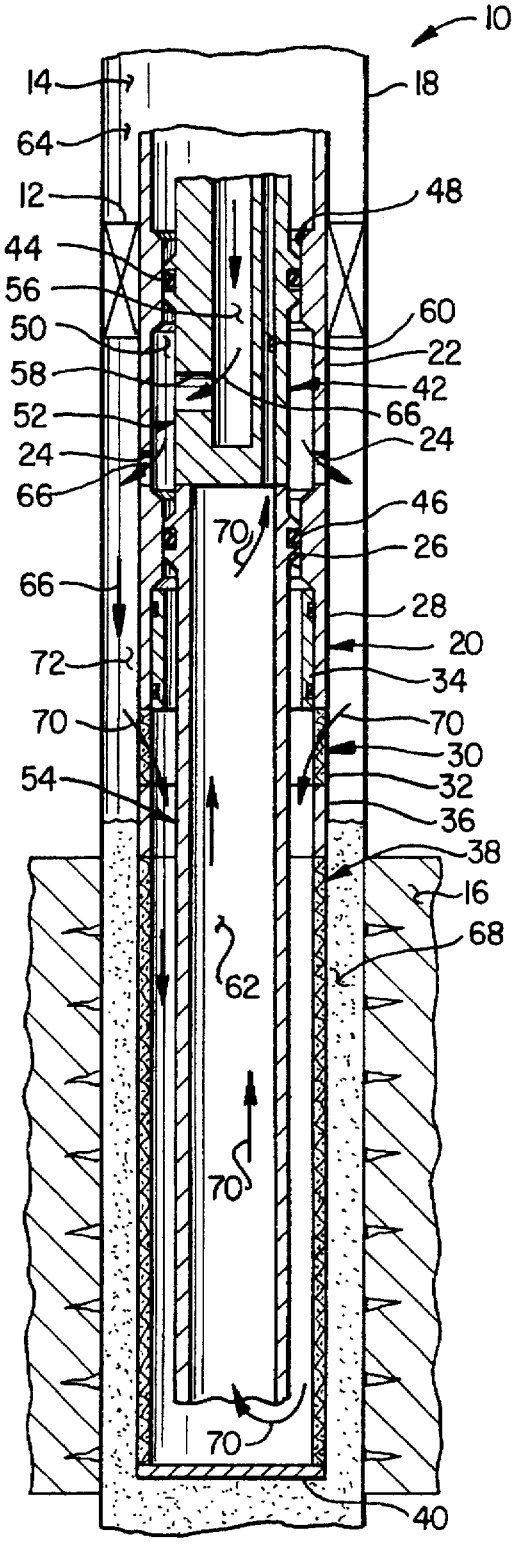

Illustrated in FIGS. 1A and 1B is a method of gravel packing a subterranean well 10 which embodies principles of the present invention. A packer 12 is set in a wellbore 14 which intersects a formation 16. The wellbore 14 is lined with protective casing 18, which has been perforated adjacent the formation 16 to thereby permit fluid communication between the formation and the wellbore 14 below the packer 12.

A tubular liner assembly 20 is attached to, and suspended from the packer 12. The liner assembly 20 includes, proceeding downwardly from the packer 12, an upper portion 22 having radially extending ports 24 formed therethrough, an axially extending inner seal bore 26, an intermediate portion 28, a specially designed apparatus 30 having a tubular screen portion 32 and a differential pressure-operated valve portion 34, a lower portion 36, and a sand control screen 38 having a lower plug 40. The liner assembly 20 is either run in the wellbore 14 attached to the packer 12, or may be separately run in the wellbore and attached to the packer after it has been set. The packer 12 is set in the casing 18 axially displaced from the formation 16, such that the screen 38 is disposed opposite the formation when the liner assembly 20 is attached to the packer.

The screen 38 is of conventional design and may be a wire-wrapped, sintered metal, or other type of screen typically utilized in gravel packing operations to prevent gravel pack material, formation sand, or other debris from entering the liner assembly 20. The screen portion 32 of the apparatus 30 may be made of material similar to that of the screen 38, or may be made of different material. Preferably, the screen portion 32 is made of a material, such as wrapped wire, which is able to withstand relatively high differential pressures and flow rates, although this may cause the screen portion 32 to have larger apertures than the screen 38.

A generally tubular tool string, known to those skilled in the art as a service tool string 42, is axially inserted in the packer 12 and liner assembly 20. The service tool string 42 may be run in the wellbore 14 coupled to the packer 12 and/or liner assembly 20, or may be run in the wellbore after the packer has been set in the casing 18. Preferably, the service tool string 42 is run in the wellbore 14 with the packer and liner assembly 20, such as is commonly done with the Multi Position Tool manufactured and sold by Halliburton Energy Services. The Multi Position Tool is described in U.S. Pat. No. 4,832,129 to Sproul et al., the disclosure of which is hereby incorporated by reference.

In a preferred mode of operation, the service tool string 42 may be axially displaced within the packer 12 and liner assembly 20. Axially spaced apart outer circumferential seals 44 and 46 on the service tool string 42 sealingly engage the internal seal bore 26 and an upper seal bore 48, respectively, such that ports 24 are axially intermediate the seal bores 26 and 48, and an annular cavity 50 is formed radially intermediate the liner assembly upper portion 22 and the tool string 42, and axially intermediate the seals 44 and 46.

The tool string 42 includes an upper crossover portion 52 and a lower washpipe portion 54. The crossover portion 52 has a central axial flow passage 56 formed therein, which extends partially through the crossover portion and which is in fluid communication with tubing (such as production tubing, not shown in FIGS. 1A and 1B) extending to the earth's surface. The flow passage 56 is also in fluid communication with the annular chamber 50 via radially extending flow port 58 formed on the crossover portion 52. A radially offset and axially extending circulation port 60 formed through the crossover portion 52 provides fluid communication between an axially extending interior washpipe bore 62 and an annular portion 64 of the wellbore 14 above the packer 12 and radially intermediate the casing 18 and the tubing extending to the earth's surface.

With the packer 12 set in the casing 18, the screen 38 positioned opposite the formation 16, and the service tool 42 disposed within the packer and liner assembly 20 as hereinabove described, a gravel pack slurry 66, including gravel 68 suspended in a fluid portion 70, is pumped downwardly through the tubing from the earth's surface. The slurry 66 enters the flow passage 56 in the crossover portion 52 and flows radially outward through flow port 58 and into annular cavity 50. From annular cavity 50, the slurry 66 flows radially outward through ports 24 into an annular space 72 below the packer 12 and radially intermediate the liner assembly 20 and the casing 18. The slurry 66 flows axially downward in annular space 72 until it eventually flows radially intermediate the screen 38 and the casing 18 opposite the formation 16.

The fluid portion 70 of the slurry 66 is permitted to flow radially inward through the screen 38, but the gravel 68 is excluded and, thus, accumulates in the wellbore 14. After the fluid portion 70 flows into the screen 38, it enters the washpipe bore 62 and then flows axially upward through the washpipe portion 54 until it reaches the crossover portion 52. The fluid portion 70 next flows in the circulation port 60 axially upward through the crossover portion 52, and thence to the annulus 64 above the packer 12. The fluid portion 70 is returned to the earth's surface through the annulus 64. Thus, it can be seen that the slurry 66 is pumped downwardly from the earth's surface to the annular space 72 between the screen 38 and the formation 16 where the gravel 68 accumulates and the fluid portion 70 passes through the screen. The fluid portion 70 is then circulated back to the earth's surface.

Screen 38 acts somewhat as a flow restrictor while the slurry 66 is being pumped into the annular space 72. This is due to the fact that the screen 38 has relatively small apertures for preventing the flow therethrough of gravel, sand, debris, etc. It will be readily apparent to one skilled in the art that a radially inwardly acting differential pressure results from the flow restriction of the screen 38. The differential pressure varies according to various factors. For example, the differential pressure is related to the slurry flow rate and the screen flow restriction such that an increase in either of these factors produces a corresponding increase in the differential pressure across the screen 38.

Screen 38 can withstand a maximum differential pressure and will collapse radially inward if that maximum differential pressure is exceeded in the gravel packing operation. For example, a typical maximum differential pressure may be approximately 5500 pounds per square inch for a welded wire-type screen suitable for use as screen 38. Such collapse of the screen 38 will typically produce very undesirable consequences, such as seizing of the washpipe portion 54 of the service tool string 42 within the screen, effectively preventing removal of the service tool string and the tubing from the wellbore 14 and necessitating great expense to retrieve and replace the service tool string and liner assembly 20. Thus, collapse of the screen 38 due to excess differential pressure is to be avoided, if possible.

As best illustrated in FIG. 1A, during initial stages of the method 10, gravel 68 accumulates about lower portions of the screen 38. It will be readily apparent to one skilled in the art that as the gravel 68 continues to accumulate about increasingly larger portions of the screen 38, the differential pressure across the screen 38 correspondingly increases. This is due to the fact that the flow restriction increases as the screen 38 is exteriorly covered with gravel 68. Thus, unless the flow rate of the slurry 66 through the screen 38 is decreased to compensate for the increased flow restriction, the differential pressure will continue to increase. Note that, as the differential pressure increases, the accumulated gravel 68 tends to compact by shifting downward in the annular space 72.

During the initial stages of the method 10, the apparatus 30 is in a closed position, preventing the fluid portion 70 from flowing radially inward through the screen portion 32. Valve portion 34 is, however, configured to displace and permit flow of the fluid portion 70 through the screen portion 32 when a predetermined differential pressure is reached. The valve portion 34 is preferably configured to permit flow through the screen portion 32 at a predetermined differential pressure somewhat less than the maximum differential pressure which the screen 38 can withstand before collapsing. Therefore, the apparatus 30 will open at a predetermined differential pressure less than the maximum differential pressure sustainable by the screen 38, permitting flow of the fluid portion 70 through the screen portion 32, decreasing the flow rate through the screen 38, and thereby decreasing the differential pressure across the screen 38.

FIG. 1B shows the apparatus 30 in its open position. The gravel 68 has accumulated about the entire axial length of the screen 38 and has greatly increased the restriction to flow through the screen 38, thereby increasing the differential pressure above the predetermined differential pressure required to displace the valve portion 34. The fluid portion 70 flows inwardly through the screen portion 32, axially downward between the screen 38 and the washpipe portion 54, into the washpipe bore 62, and thence to the earth's surface as described hereinabove. After the apparatus 30 is opened, the differential pressure decreases, helping to prevent collapse of the screen 38.

Figure 2A:
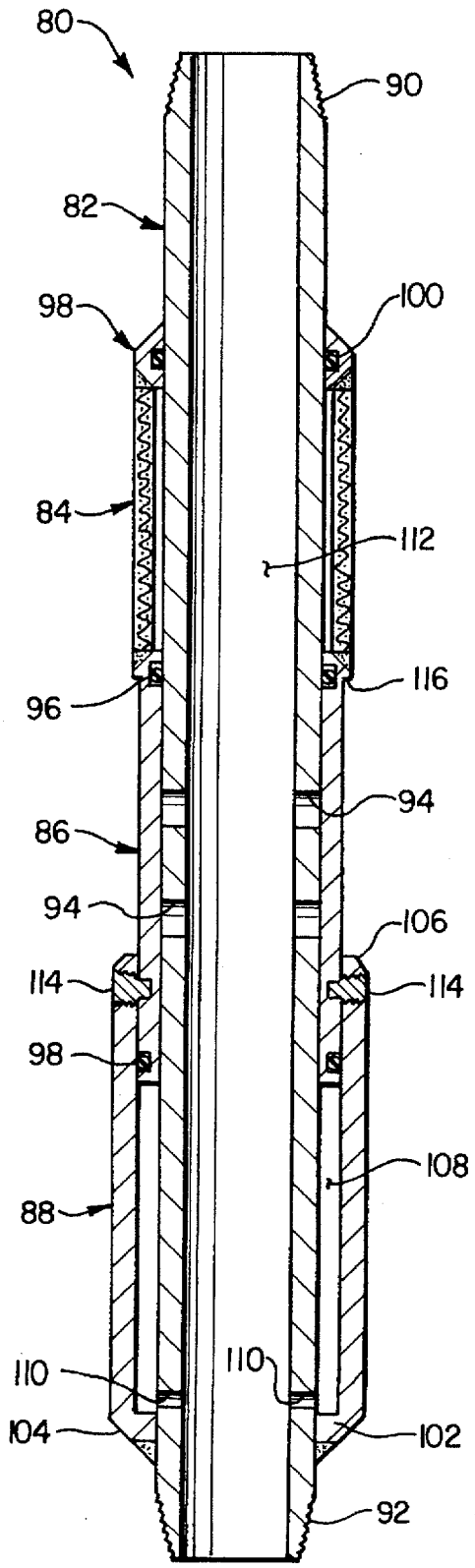
FIGS. 2A and 2B are cross-sectional views of a first gravel packing apparatus embodying principles of the present invention.
Figure 2B:
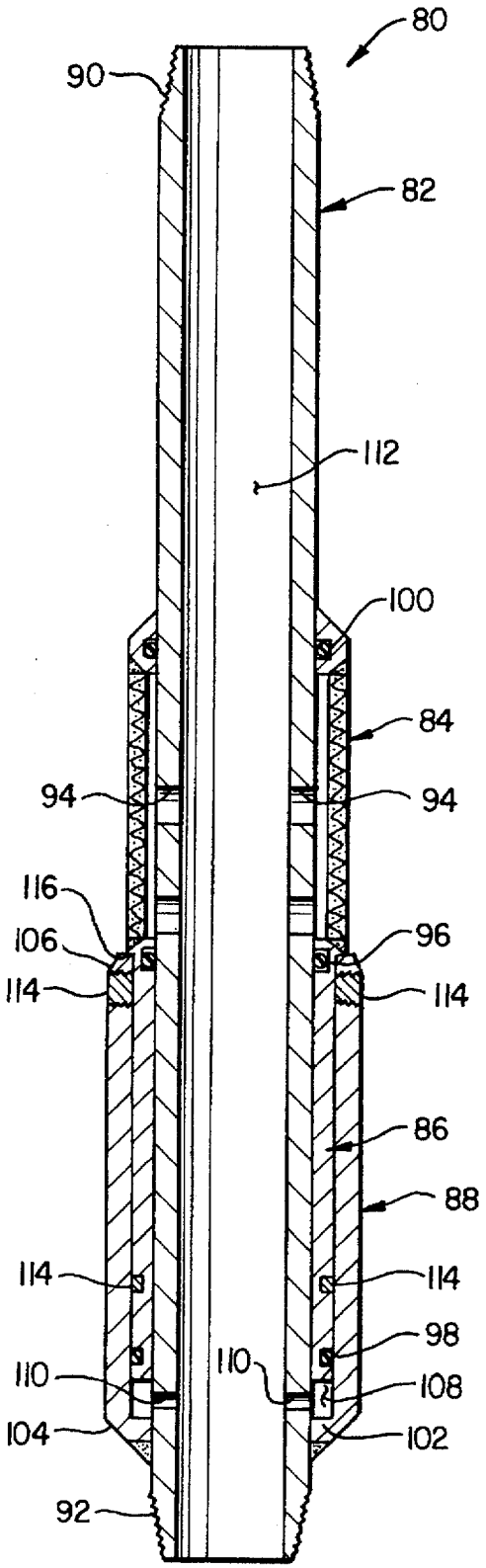

Turning now to FIGS. 2A and 2B, a gravel packing apparatus 80 embodying principles of the present invention, suitable for use as apparatus 30 in the method 10, may be seen. The apparatus 80 includes a tubular inner mandrel 82, a tubular screen 84, a tubular sleeve 86, and a tubular outer housing 88. The inner mandrel 82 has threaded upper and lower end connections 90 and 92, respectively, for sealing attachment into the liner assembly 20 representatively illustrated in FIGS. 1A and 1B. Thus, upper end connection 90 is threadedly and sealingly attached to intermediate portion 28, and lower end connection 92 is threadedly and sealingly attached to the lower portion 36 when apparatus 80 is used for apparatus 30 in method 10.

As representatively illustrated in FIG. 2A, sleeve 86 is coaxially disposed relative to the inner mandrel 82 and radially outwardly overlies four radially extending ports 94 formed therethrough. An inner circumferential seal 96 on the sleeve 86 sealingly engages the inner mandrel 82. An outer circumferential seal 98 on the sleeve 86 sealingly engages the outer housing 88. Ports 94 are axially intermediate the seals 96 and 98, and the seals and sleeve 86 thus prevent flow radially through the ports.

Screen 84 is coaxially and exteriorly disposed relative to the inner mandrel 82 and is attached at one end, preferably by welding, to the sleeve 86 proximate the seal 96. The screen 84 extends upwardly from the sleeve 86 and is attached at its other end, preferably by welding, to an end portion 98 which also coaxially and exteriorly overlies the inner mandrel 82. A circumferential seal 100 on the end portion 98 sealingly engages the inner mandrel 82.

Outer housing 88 coaxially and exteriorly overlies the inner mandrel 82 and is preferably welded thereto at a lower end 104 adjacent a radially reduced portion 102 of the outer housing. An upper end 106 of the outer housing 88 also coaxially and exteriorly overlaps the sleeve 86. An annular chamber 108 is formed axially intermediate the radially reduced portion 102 and the sleeve 86, and radially intermediate the outer housing 88 and the inner mandrel 82. Two openings 110 provide fluid communication between the annular chamber 108 and an axially extending bore 112 formed through the inner mandrel 82.

It is to be understood that the placement, proportions, and number of openings, ports, flow passages, etc. described herein may be varied without departing from the principles of the present invention. For example, inner mandrel 82 may have two or six ports 94 formed thereon, instead of four. It is also to be understood that each of the welded connections described herein may be otherwise connected without departing from the principles of the present invention. For example, outer housing 88 may be threadedly and sealingly attached to the inner mandrel 82 instead of being welded thereto.

Pressure in the inner mandrel bore 112 biases sleeve 86 upwardly, since chamber 108 is in fluid communication with the bore 112 via openings 110. Pressure external to the apparatus 80 biases the sleeve 86 downwardly. Thus, differential pressure acting from external to internal of the apparatus 80 biases the sleeve 86 downwardly.

Two shear pins 114 are installed radially through the outer housing 88 proximate its upper end 106. The shear pins 114 extend radially inward and partially into the sleeve 86, thereby securing the sleeve in its closed position, as representatively illustrated in FIG. 2A, until sufficient differential pressure is present to shear the shear pins. Preferably, the shear pins 114 are made of a suitable material and are appropriately proportioned to have a shear strength such that they will shear somewhat before the differential pressure is sufficient to collapse the screen 38 (see FIG. 1A).

Shear pins 114 may be made of alloy steel, brass, or any other suitable material without departing from the principles of the present invention. Likewise, the proportions and number of shear pins 114 may be varied without departing from the principles of the present invention. Shear pins 114 thus permit the differential pressure at which the sleeve 86 displaces relative to the inner mandrel 82 to be predetermined.

FIG. 2B shows the apparatus 80 in its open configuration. Sleeve 86 has axially downwardly displaced relative to the inner mandrel 82, and has further entered into the annular chamber 108. Shear pins 114 have been sheared, the predetermined differential pressure having been achieved. Screen 84 now exteriorly overlies the ports 94, permitting flow radially therethrough. A radially extending shoulder 116 formed on the sleeve 86 abuts the upper end 106 of the outer housing 88, preventing further downward displacement of the sleeve.

Referring now additionally to FIGS. 1A and 1B, in the open position of the apparatus 80 as representatively illustrated in FIG. 2B, the fluid portion 70 of the slurry 66 may pass through the screen 84, radially inward through the ports 94, and thence into inner mandrel bore 112, for circulation back to the earth's surface as described hereinabove.

An important additional benefit is derived from the attachment of the screen 84 to the sleeve 86 and its displacement downwardly therewith when shear pins 114 shear. As set forth hereinabove in the detailed description accompanying FIG. 1B, an accumulation of gravel 68 about the exterior of the screen 38 typically causes an increase in the differential pressure. It may happen that the gravel 68 accumulates about the exterior of the apparatus 80 before the predetermined differential pressure is achieved. In that case, the downward shifting of the gravel 68 as the differential pressure increases will aid in shifting the sleeve 86 downward to open the apparatus 80 and relieve the differential pressure.

Figure 3A:
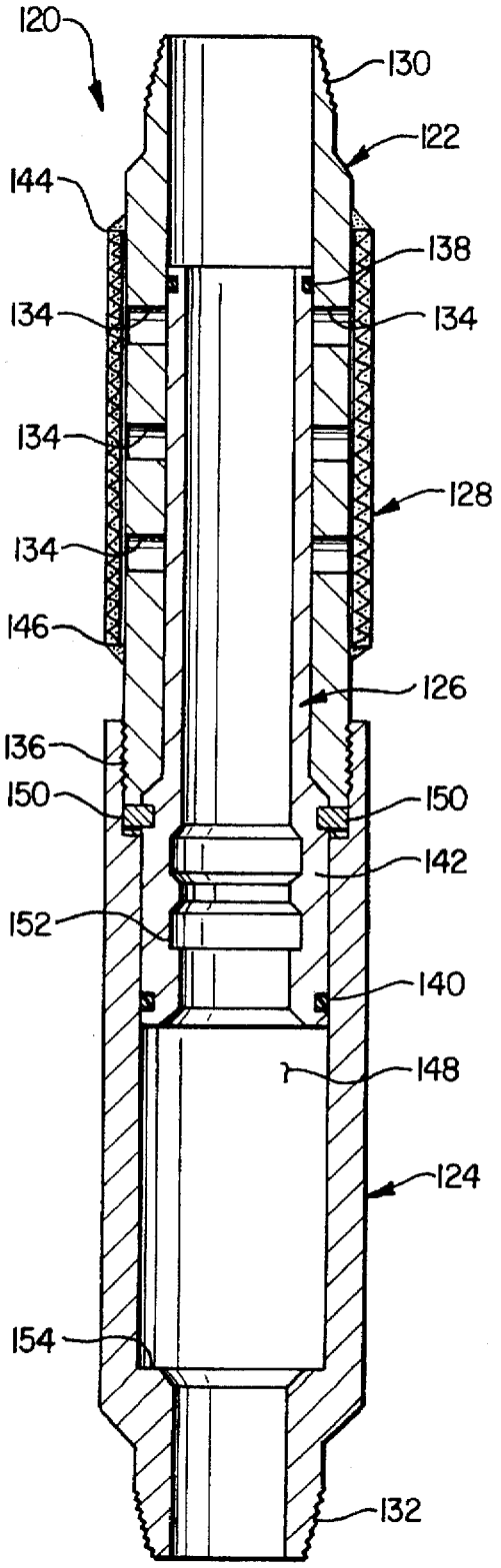
FIGS. 3A and 3B are cross-sectional views of a second gravel packing apparatus embodying principles of the present invention.
Figure 3B:
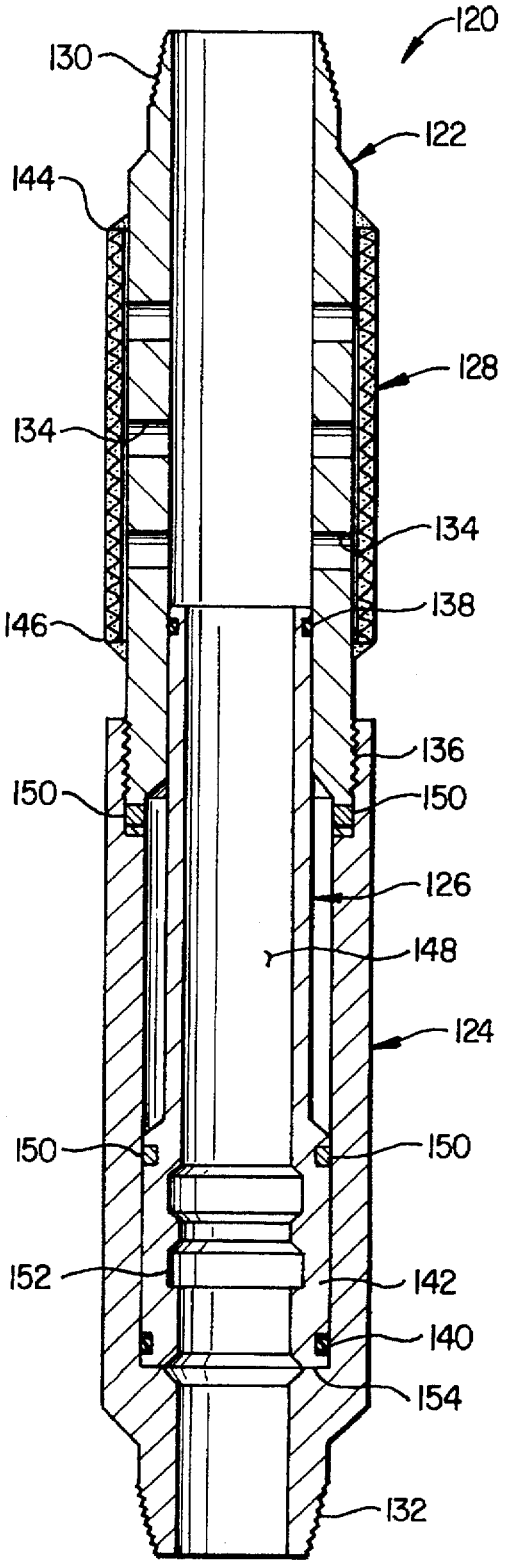

Turning now to FIGS. 3A and 3B, another gravel packing apparatus 120 embodying principles of the present invention is representatively illustrated, which may be utilized for the apparatus 30 in the method 10 shown in FIGS. 1A and 1B. The apparatus 120 includes tubular upper housing 122, tubular lower housing 124, tubular sleeve 126, and tubular screen 128. The upper housing 122 has threaded upper end connection 130, and the lower housing 124 has threaded lower end connection 132, for sealing attachment into the liner assembly 20 representatively illustrated in FIGS. 1A and 1B. Thus, upper end connection 130 is threadedly and sealingly attached to intermediate portion 28, and lower end connection 132 is threadedly and sealingly attached to the lower portion 36 when apparatus 120 is used for apparatus 30 in method 10.

As representatively illustrated in FIG. 3A, sleeve 126 is coaxially disposed relative to the upper and lower housings 122 and 124 and radially inwardly overlies six radially extending ports 134 formed on the upper housing. Sleeve 126 also extends axially across a threaded connection 136 between the upper and lower housings 122 and 124, a radially enlarged portion 142 formed on the sleeve extending into the lower housing. An outer circumferential seal 138 on the sleeve 126 sealingly engages the upper housing 122. An outer circumferential seal 140 on the radially enlarged portion 142 of the sleeve 126 sealingly engages the lower housing 124. Ports 134 are axially intermediate the seals 138 and 140, and the seals and sleeve 126 thus prevent flow radially through the ports.

Screen 128 is coaxially and exteriorly disposed relative to the upper housing 122 and is attached at each end 144 and 146, preferably by welding, to the exterior surface of the upper housing. Ports 134 are disposed axially intermediate the screen ends 144 and 146, such that fluid flowing radially inward through the ports must first pass through the screen 128.

Pressure in an interior bore 148 extending through the upper housing 122, sleeve 126, and lower housing 124, biases the sleeve upwardly. Pressure external to the apparatus 120 biases the sleeve 126 downwardly. Thus, differential pressure acting from external to internal of the apparatus 120 acts to bias the sleeve 126 downwardly.

Two shear pins 150 are installed radially through the upper housing 122 proximate the threaded connection 136. The shear pins 150 extend radially inward and partially into the sleeve 126, thereby securing the sleeve in its closed position, as representatively illustrated in FIG. 3A, until sufficient differential pressure is present to shear the shear pins. Preferably, the shear pins 150 are made of a suitable material and are appropriately proportioned to have a shear strength such that they will shear somewhat before the differential pressure is sufficient to collapse the screen 38 (see FIG. 1A).

Shear pins 150 may be made of alloy steel, brass, or any other suitable material without departing from the principles of the present invention. Likewise, the proportions and number of shear pins 150 may be varied without departing from the principles of the present invention. Shear pins 150 thus permit the differential pressure at which the sleeve 126 displaces relative to the upper housing 122 to be predetermined.

Sleeve 126 includes an internal shifting profile 152 formed thereon. Shifting profile 152 permits engagement therewith by a conventional wireline or slickline shifting tool (not shown) for displacing sleeve 126 relative to the upper and lower housings 122 and 124 before or after the shear pins 150 have been sheared by the predetermined differential pressure. A downward jarring force may be applied to the sleeve shifting profile 152 by the shifting tool to shear the shear pins 150 and displace the sleeve 126 downward to open the ports 134 for flow therethrough, or, after the ports have been opened, an upward force may be applied to the shifting profile to displace the sleeve upwardly to thereby close the ports.

FIG. 3B shows the apparatus 120 in its open configuration. Sleeve 126 has axially downwardly displaced relative to the upper housing 122, and the radially enlarged portion 142 has displaced further into the lower housing 124. Shear pins 150 have been sheared, the predetermined differential pressure having been achieved. Flow is now permitted inwardly through the ports 134, passing first through the screen 128. A radially extending shoulder 154 formed internally on the lower housing 124 abuts the radially enlarged portion 142 of the sleeve 126, preventing further downward displacement of the sleeve.

Referring now additionally to FIGS. 1A and 1B, in the open position of the apparatus 120 as representatively illustrated in FIG. 3B, the fluid portion 70 of the slurry 66 may pass through the screen 128, radially inward through the ports 134, and thence into bore 148, for circulation back to the earth's surface as described hereinabove.

Thus have been described two embodiments of gravel packing apparatus 80 and 120 which may be attached to the liner assembly 20 in the gravel packing method 10. Use of the apparatus 80 and 120 aids in preventing collapse of sand control screen 38 and does not require sealing engagement of a washpipe between sand control screens. The apparatus 80 and 120 also do not rely solely on differential pressure for activation thereof, and do not reciprocate between open and closed positions.

Figure 4A:
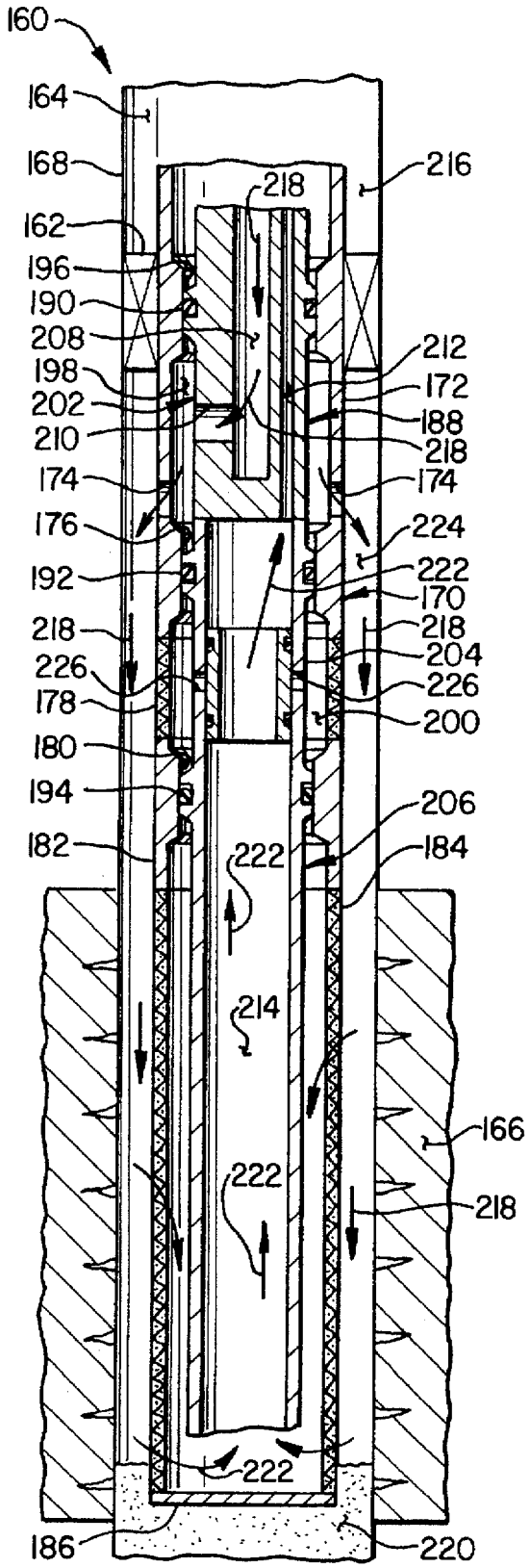
FIGS. 4A and 4B are highly schematicized cross-sectional views of a second method of gravel packing a subterranean well embodying principles of the present invention.
Figure 4B:
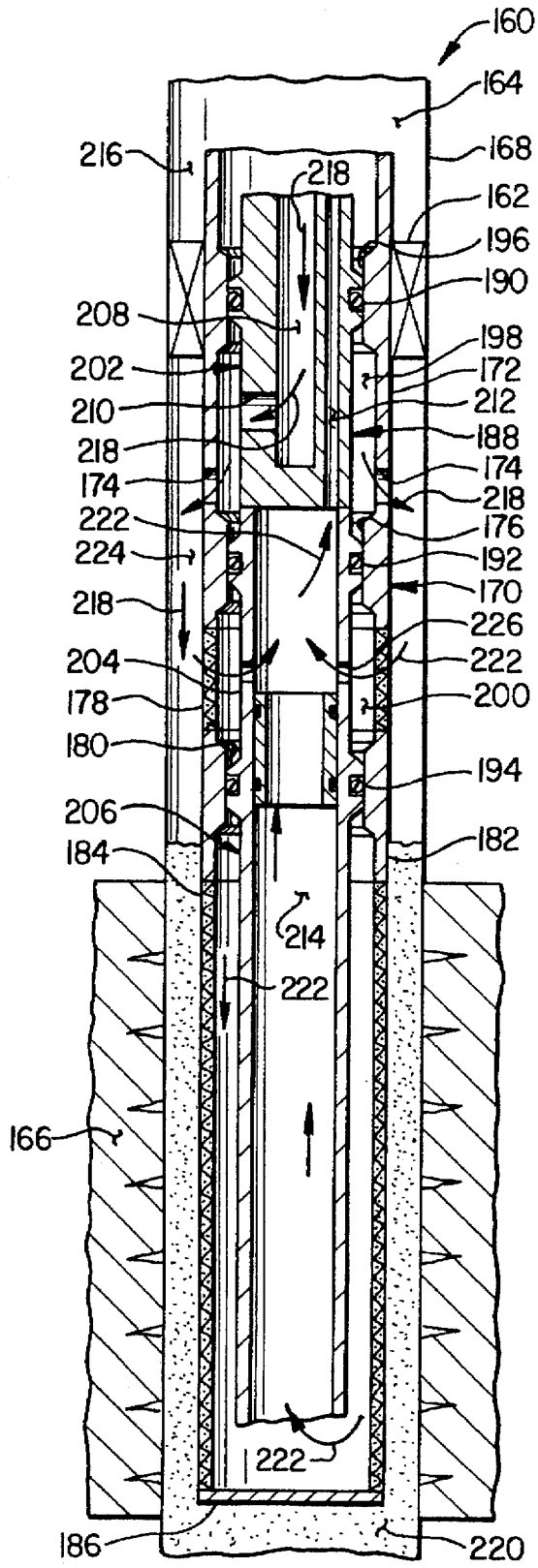

Illustrated in FIGS. 4A and 4B is a method of gravel packing a subterranean well 160 which embodies principles of the present invention. A packer 162 is set in a wellbore 164 which intersects a formation 166. The wellbore 164 is lined with protective casing 168, which has been perforated adjacent the formation 166 to thereby permit fluid communication between the formation and the wellbore 164 below the packer 162.

A tubular liner assembly 170 is attached to, and suspended from the packer 162. The liner assembly 170 includes, proceeding downwardly from the packer 162, an upper portion 172 having radially extending ports 174 formed therethrough, an axially extending inner seal bore 176, a screen portion 178, an axially extending inner seal bore 180, a lower portion 182, and a sand control screen 184 having a lower plug 186. The liner assembly 170 is either run in the wellbore 164 attached to the packer 162, or may be separately run in the wellbore and attached to the packer after it has been set. The packer 162 is set in the casing 168 axially displaced from the formation 166, such that the screen 184 is disposed opposite the formation when the liner assembly 170 is attached to the packer.

The screen 184 is of conventional design and may be a wire-wrapped, sintered metal, or other type of screen typically utilized in gravel packing operations to prevent gravel pack material, formation sand, or other debris from entering the liner assembly 170. The screen portion 178 of the liner assembly 170 may be made of material similar to that of the screen 184, or may be made of different material. Preferably, the screen portion 178 is made of a material, such as wrapped wire, which is able to withstand relatively high differential pressures and flow rates, although this may cause the screen portion 178 to have larger apertures than the screen 184.

A generally tubular tool string, known to those skilled in the art as a service tool string 188, is axially inserted in the packer 162 and liner assembly 170. The service tool string 188 may be run in the wellbore 164 coupled to the packer 162 and/or liner assembly 170, or may be run in the wellbore after the packer has been set in the casing 168. Preferably, the service tool string 188 is run in the wellbore 164 with the packer and liner assembly 170, such as is commonly done with the Multi Position Tool manufactured and sold by Halliburton Energy Services. In a preferred mode of operation, the service tool string 188 may be axially displaced within the packer 162 and liner assembly 170. Axially spaced apart outer circumferential seals 190, 192, and 194 on the service tool string 188 sealingly engage the internal seal bores 176 and 180 and an upper seal bore 196, respectively. Ports 174 are axially intermediate the seal bores 196 and 176, and an upper annular cavity 198 is formed radially intermediate the liner assembly upper portion 172 and the tool string 188, and axially intermediate the seals 190 and 192. Screen portion 178 is axially intermediate the seal bores 176 and 180, forming a lower annular cavity 200 radially intermediate the screen portion 178 and the tool string 188, and axially intermediate the seals 192 and 194.

The tool string 188 includes an upper crossover portion 202, a valve portion 204, and a lower washpipe portion 206. The crossover portion 202 has a central axial flow passage 208 formed therein, which extends partially through the crossover portion and which is in fluid communication with tubing (such as production tubing, not shown in FIGS. 4A and 4B) extending to the earth's surface. The flow passage 208 is also in fluid communication with the annular chamber 198 via radially extending flow port 210 formed on the crossover portion 202. A radially offset and axially extending circulation port 212 formed through the crossover portion 202 provides fluid communication between an axially extending interior washpipe bore 214 and an annular portion 216 of the wellbore 164 above the packer 162 and radially intermediate the casing 168 and the tubing extending to the earth's surface.

With the packer 162 set in the casing 168, the screen 184 positioned opposite the formation 166, and the service tool string 188 disposed within the packer and liner assembly 170 as hereinabove described, a gravel pack slurry 218, including gravel 220 suspended in a fluid portion 222, is pumped downwardly through the tubing from the earth's surface. The slurry 218 enters the flow passage 208 in the crossover portion 202 and flows radially outward through flow port 210 and into annular cavity 198. From annular cavity 198, the slurry 218 flows radially outward through ports 174 into an annular space 224 below the packer 162 and radially intermediate the liner assembly 170 and the casing 168. The slurry 218 flows axially downward in annular space 224 until it eventually flows radially intermediate the screen 184 and the casing 168 opposite the formation 166.

The fluid portion 222 of the slurry 218 is permitted to flow radially inward through the screen 184, but the gravel 220 is excluded and, thus, accumulates in the wellbore 164. After the fluid portion 222 flows into the screen 184, it enters the washpipe bore 214 and then flows axially upward through the washpipe portion 206 until it reaches the crossover portion 202. The fluid portion 222 next flows in the circulation port 212 axially upward through the crossover portion 202, and thence to the annulus 216 above the packer 162. The fluid portion 222 is returned to the earth's surface through the annulus 216. Thus, it can be seen that the slurry 218 is pumped downwardly from the earth's surface to the annular space 224 between the screen 184 and the formation 166 where the gravel 220 accumulates and the fluid portion 222 passes through the screen. The fluid portion 222 is then circulated back to the earth's surface.

Screen 184 acts somewhat as a flow restrictor while the slurry 218 is being pumped into the annular space 224. This is due to the fact that the screen 184 has relatively small apertures for preventing the flow therethrough of gravel, sand, debris, etc. It will be readily apparent to one skilled in the art that a radially inwardly acting differential pressure results from the flow restriction of the screen 184. The differential pressure varies according to various factors. For example, the differential pressure is related to the slurry flow rate and the screen flow restriction such that an increase in either of these factors produces a corresponding increase in the differential pressure across the screen 184.

Screen 184 can withstand a maximum differential pressure and will collapse radially inward if that maximum differential pressure is exceeded in the gravel packing operation. For example, a typical maximum differential pressure may be approximately 5500 pounds per square inch for a welded wire-type screen suitable for use as screen 184. Such collapse of the screen 184 will typically produce very undesirable consequences, such as seizing of the washpipe portion 206 of the service tool string 188 within the screen, effectively preventing removal of the service tool string and the tubing from the wellbore 164 and necessitating great expense to retrieve and replace the service tool string and liner assembly 170. Thus, collapse of the screen 184 due to excess differential pressure is to be avoided, if possible.

As best illustrated in FIG. 4A, during initial stages of the method 160, gravel 220 accumulates about lower portions of the screen 184. It will be readily apparent to one skilled in the art that as the gravel 220 continues to accumulate about increasingly larger portions of the screen 184, the differential pressure across the screen 184 correspondingly increases. This is due to the fact that the flow restriction increases as the screen 184 is exteriorly covered with gravel 220. Thus, unless the flow rate of the slurry 218 through the screen 184 is decreased to compensate for the increased flow restriction, the differential pressure will continue to increase.

During the initial stages of the method 170, the valve portion 204 is in a closed position, preventing the fluid portion 220 from flowing radially inward through radially extending ports 226 formed through the valve portion. The fluid portion 220 may pass radially inward through screen portion 178 and into lower annular chamber 200, but is not permitted to flow into washpipe bore 214 when ports 226 are closed. Valve portion 204 is, however, configured to displace and permit flow of the fluid portion 220 through the ports 226 when a predetermined differential pressure is reached. The valve portion 204 is preferably configured to permit flow through ports 226 at a predetermined differential pressure somewhat less than the maximum differential pressure which the screen 184 can withstand before collapsing. Therefore, the valve portion 204 will open at a predetermined differential pressure less than the maximum differential pressure sustainable by the screen 186, permitting flow of the fluid portion 220 through the ports 226, decreasing the flow rate through the screen 184, and thereby decreasing the differential pressure across the screen 184. Valve portion 204 does not then reclose after the differential pressure has decreased. In this respect, valve portion 204 is not a reciprocating valve.

FIG. 4B shows the valve portion 204 in its open position. The gravel 220 has accumulated about the entire axial length of the screen 184 and has greatly increased the restriction to flow through the screen 184, thereby increasing the differential pressure above the predetermined differential pressure required to open the valve portion 204. The fluid portion 220 flows inwardly through the screen portion 178, into the lower annular chamber 200, radially inward through ports 226, into the washpipe bore 214, and thence to the earth's surface as described hereinabove. After the valve portion 204 is opened, the differential pressure decreases, helping to prevent collapse of the screen 184.

Thus has been disclosed the method of gravel packing a subterranean well 160 which utilizes a nonreciprocating valve portion 204 attached to a washpipe portion 206. External seals 190, 192, and 194 are utilized on the service tool string 188 to sealingly engage inner seal bores 196,176, and 180, such that the seals may be conveniently replaced, in the event they become damaged, by lifting the service tool string from the wellbore 164, leaving the packer 162 and liner assembly 170 properly positioned in the wellbore.

Figure 5A:
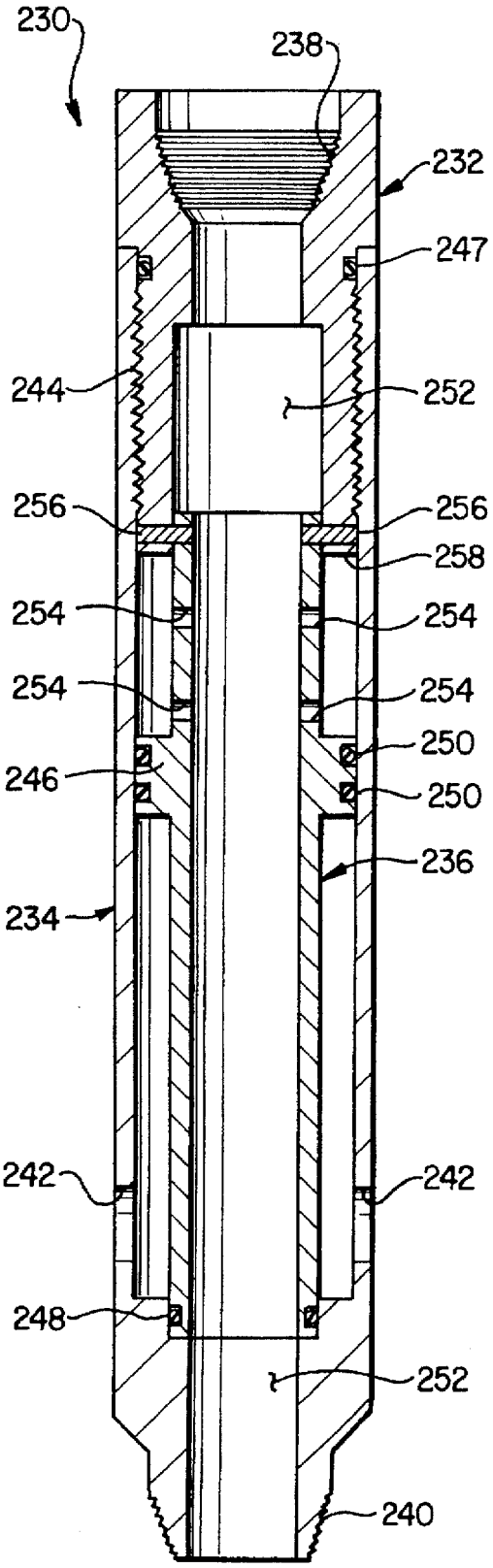
FIG. 5A (PRIOR ART)
FIGS. 5A and 5B are cross-sectional views of a prior art valve suitable for use in the second gravel packing method.
Figure 5B:
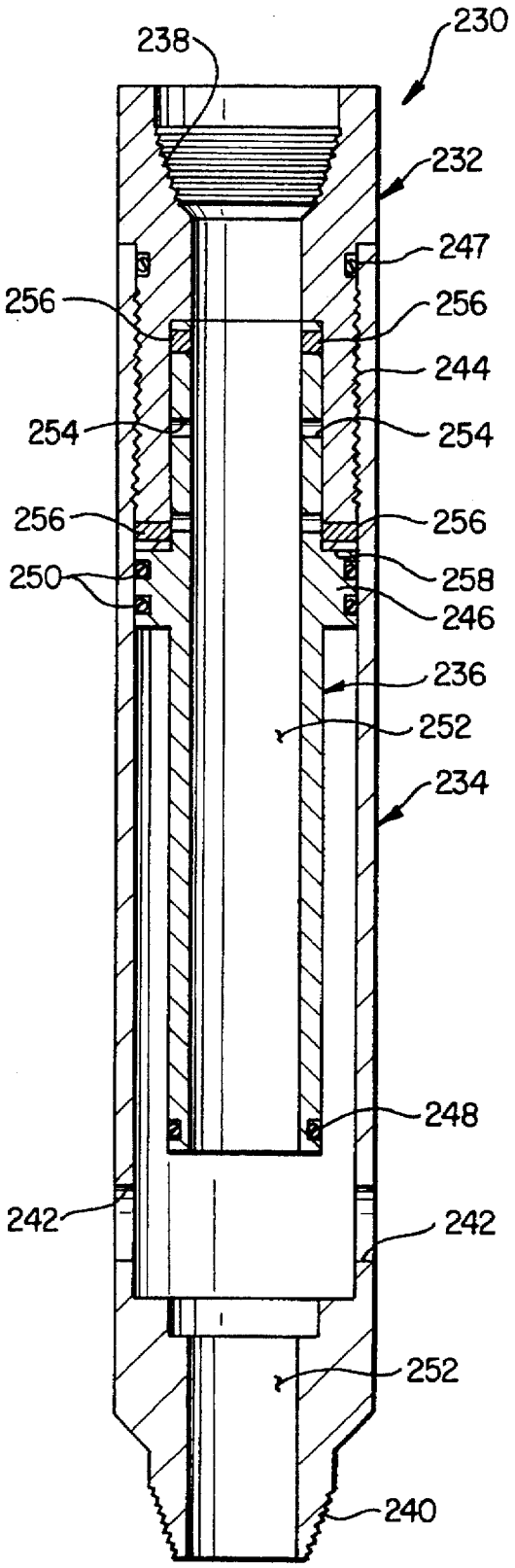
FIG. 5B (PRIOR ART)

FIGS. 5A and 5B show a prior art valve 230 suitable for use as the valve portion 204 in method 160 representatively illustrated in FIGS. 4A and 4B. The valve 230 is similar to Part No. 1200985 manufactured and sold by Halliburton Energy Services. The valve 230 includes tubular upper housing 232, tubular lower housing 234, and tubular sleeve 236. The upper housing 232 has threaded upper end connection 238, and the lower housing 234 has threaded lower end connection 240, for sealing attachment into the service tool string 188 representatively illustrated in FIGS. 4A and 4B. Thus, upper end connection 238 is threadedly and sealingly attached to the washpipe portion 206 extending downwardly from the crossover portion 202, and lower end connection 240 is threadedly and sealingly attached to the washpipe portion 206 extending downwardly and within the screen 184 when valve 230 is used for valve portion 204 in method 160.

As representatively illustrated in FIG. 5A, sleeve 236 is coaxially disposed relative to the upper and lower housings 232 and 234 and radially inwardly overlies two radially extending ports 242 formed on the lower housing. Sleeve 236 also extends axially across a threaded connection 244 between the upper and lower housings 232 and 234, a radially enlarged portion 246 formed on the sleeve extending into the lower housing.

Circumferential seal 247 on the upper housing 232 sealingly engages the lower housing 234 proximate the threaded connection 244. An outer circumferential seal 248 on the sleeve 236 sealingly engages the lower housing 232. Two outer circumferential seals 250 on the radially enlarged portion 246 of the sleeve 236 sealingly engage the lower housing 234. Ports 242 are axially intermediate the seals 248 and 250, and the seals and sleeve 236 thus prevent flow radially through the ports.

Pressure in an interior bore 252 extending through the upper housing 232, sleeve 236, and lower housing 234, acting through four radially extending ports 254 formed through the sleeve 236, biases the sleeve downwardly. Pressure external to the valve 230, acting through the ports 242, biases the sleeve 236 upwardly. Thus, differential pressure acting from external to internal of the valve 230 acts to bias the sleeve 236 upwardly.

Two shear pins 256 are installed radially through the upper housing 232 proximate the threaded connection 244. The shear pins 256 extend radially inward and through the sleeve 236, thereby securing the sleeve in its closed position, as representatively illustrated in FIG. 5A, until sufficient differential pressure is present to shear the shear pins. The shear pins 256 are made of a suitable material and are appropriately proportioned to have a shear strength such that they will shear somewhat before the differential pressure is sufficient to collapse the screen 184 (see FIG. 4A). Shear pins 256 thus permit the differential pressure at which the sleeve 236 displaces relative to the lower housing 234 to be predetermined.

FIG. 5B shows the valve 230 in its open configuration. Sleeve 236 has axially upwardly displaced relative to the lower housing 234. Shear pins 256 have been sheared, the predetermined differential pressure having been achieved. Flow is now permitted through the ports 242. A radially extending shoulder 258 formed internally on the upper housing 232 abuts the radially enlarged portion 246 of the sleeve 236, preventing further upward displacement of the sleeve.

Referring now additionally to FIGS. 4A and 4B, in the open position of the valve portion 204 as representatively illustrated in FIG. 5B, the fluid portion 222 of the slurry 218 may pass through the screen portion 178, radially inward through the ports 242, and thence into bore 252, for circulation back to the earth's surface as described hereinabove.

The foregoing detailed description is to be clearly understood as being given by way of illustration and example only, the spirit and scope of the present invention being limited solely by the appended claims.

What is claimed is:

1. For use in a subterranean wellbore wherein a liner assembly having an interior bore is suspended from a packer set in the wellbore, gravel packing apparatus comprising:

an axially extending tubular member having internal and external surfaces, opposite ends sealingly interconnectable into the liner assembly, a port extending radially between said internal and external surfaces, and a flow passage extending axially between said opposite ends, said flow passage being communicatable with the liner assembly interior bore;

a tubular sleeve coaxially and slidably engaging said tubular member and having first and second seals disposed thereon, said first seal being disposed on a first diameter formed on said sleeve and said second seal being disposed on a second diameter formed on said sleeve, said second diameter being larger than said first diameter and being axially spaced apart therefrom, and said sleeve having a closed position wherein said first and second seals axially straddle said tubular member port and an open position wherein one of said first and second seals is axially intermediate said port and the other of said first and second seals; and a tubular screen coaxially attached to said tubular member and being disposed relative to said port, such that flow from the wellbore to the liner assembly interior bore through said port must pass through said screen.

2. The apparatus according to claim 1, further comprising a frangible member releasably securing said sleeve in said closed position.

3. The apparatus according to claim 2, wherein said frangible member releases said sleeve for displacement relative to said tubular member from said closed position to said open position at a predetermined differential pressure between a pressure in the wellbore external to the liner assembly and a pressure in the interior bore of the liner assembly.

4. The apparatus according to claim 1, wherein said screen is slidably attached to said tubular member and secured to said sleeve, said screen being axially spaced apart from said port when said sleeve is in said closed position, and said screen being radially opposite and aligned with said port when said sleeve is in said open position.

5. The apparatus according to claim 4, wherein said screen has opposite ends, one of said screen opposite ends being secured to said sleeve and the other of said screen opposite ends having a third seal disposed thereon, said port being axially intermediate said first and second seals when said sleeve is in said closed position, and said port being axially intermediate said third seal and one of said first and second seals when said sleeve is in said open position.

6. The apparatus according to claim 1, wherein said screen has opposite ends, said opposite ends being mounted to said tubular member radially opposite said port, said port being axially intermediate said screen opposite ends.

7. The apparatus according to claim 6, wherein said screen radially outwardly overlies said port, and wherein said screen opposite ends are welded to said tubular member.

8. The apparatus according to claim 6, wherein said screen radially outwardly overlies said port, and wherein said sleeve radially inwardly overlies said port when said sleeve is in said closed position.

9. Gravel packing apparatus operatively positionable in a subterranean well, the apparatus comprising:

an axially elongated tubular mandrel having an axially extending internal flow passage formed therethrough, an external side surface, and a port permitting fluid communication between said flow passage and said external side surface;

an axially elongated tubular housing having an internal side surface and opposite ends, one of said housing opposite ends being sealingly attached to said mandrel external side surface, said housing radially outwardly overlying and being radially spaced apart from said mandrel and forming an annular space radially intermediate said mandrel external side surface and said housing internal side surface;

a tubular sleeve coaxially and slidably disposed on said mandrel, said sleeve having internal and external side surfaces and opposite ends, one of said sleeve opposite ends being radially intermediate said mandrel external side surface and said housing internal side surface and further being received in said annular space;

a first seal disposed on said sleeve external side surface and sealingly engaging said housing internal side surface;

a second seal disposed on said sleeve internal side surface axially spaced apart from said first seal, said second seal sealingly engaging said mandrel external side surface; and a tubular screen coaxially and slidably disposed on said mandrel and having opposite ends, said screen being attached to said sleeve for sliding displacement therewith relative to said mandrel.

10. The apparatus according to claim 9, wherein said screen is radially outwardly disposed relative to said mandrel external surface, and wherein one of said screen opposite ends is attached to the other of said sleeve opposite ends.

11. The apparatus according to claim 10, wherein the other of said screen opposite ends has a third seal disposed thereon, said third seal sealingly engaging said mandrel external side surface.

12. The apparatus according to claim 11, wherein said sleeve has a closed position wherein said port is axially intermediate said first and second seals, and an open position, axially displaced from said closed position, wherein said port is axially intermediate said second and third seals.

13. The apparatus according to claim 12, further comprising a frangible member releasably securing said sleeve in said closed position, said frangible member releasing said sleeve for displacement to said open position when a predetermined differential pressure is applied across said sleeve.

14. The apparatus according to claim 9, further comprising an opening formed radially through said mandrel, said opening permitting fluid communication between said internal flow passage and said annular space axially intermediate said one of said sleeve opposite ends and said one of said housing opposite ends.

15. Gravel packing apparatus operatively positionable in a subterranean well, the apparatus comprising:

a first tubular member having interior and exterior side surfaces, and further having a radially extending port formed therethrough permitting fluid communication between said first tubular member interior and exterior side surfaces;

a tubular screen exteriorly and coaxially disposed relative to said first tubular member, said screen radially outwardly overlying said port, said screen having opposite ends sealingly attached to said first tubular member exterior side surface, and said screen opposite ends axially straddling said port; and a tubular sleeve interiorly and coaxially disposed relative to said first tubular member, said sleeve having first and second exterior surfaces formed thereon and first and second seals disposed on said sleeve first and second exterior surfaces, respectively, said first seal sealingly engaging said first tubular member interior side surface, and said sleeve slidably and axially displacing from a closed position to an open position thereof.

16. The apparatus according to claim 15, further comprising a frangible member releasably securing said sleeve in said closed position and releasing said sleeve for displacement relative to said first tubular member when a predetermined differential pressure is applied across said sleeve.

17. The apparatus according to claim 15, wherein said sleeve second exterior surface is radially enlarged relative to said sleeve first exterior surface.

18. The apparatus according to claim 17, further comprising a second tubular member having an interior side surface, said second tubular member being coaxially attached to said first tubular member and extending outwardly therefrom, and said second seal sealingly engaging said second tubular member interior side surface.

19. The apparatus according to claim 15, wherein said sleeve further has an interior side surface and a shifting profile formed on said sleeve interior side surface.

20. The apparatus according to claim 15, wherein said port is axially intermediate said first and second seals and said sleeve radially inwardly overlies said port when said sleeve is in said closed position.

21. A method of gravel packing a subterranean well, said well having a wellbore intersecting a formation and a packer set in the wellbore, the method comprising the steps of:

providing a tubular liner assembly, said liner assembly including an interior bore, a radially extending flow port, axially interconnected first and second elongated screens, and a valve portion, said valve portion being operative to permit flow through said first screen when a predetermined pressure differential is applied across said valve portion;

attaching said liner assembly to the packer;

positioning said liner assembly in said wellbore such that said second screen is opposite said formation;

providing a service tool string, said service tool string including a crossover portion and a washpipe portion; and inserting said service tool string axially into said liner assembly.

22. The method according to claim 21, wherein said liner assembly providing step further comprises providing said liner assembly including an internal seal bore interconnected axially intermediate said flow port and said valve portion, wherein said service tool string providing step further comprises providing said service tool string having an external seal disposed thereon axially intermediate said crossover portion and said washpipe portion, and wherein said inserting step further comprises sealingly engaging said external seal in said internal seal bore.

23. The method according to claim 22, further comprising the steps of:

flowing a slurry through said crossover portion, outwardly through said flow port, and into said wellbore radially intermediate said liner assembly and the formation;

flowing a fluid portion of the slurry inwardly through said second screen and into an internal flow passage within said liner assembly; and creating a differential pressure across said liner assembly.

24. The method according to claim 23, further comprising the steps of:

increasing said differential pressure across said liner assembly to said predetermined differential pressure; and opening said valve portion in response to said increasing step to thereby decrease said differential pressure below said predetermined differential pressure.

25. The method according to claim 21, wherein said liner assembly providing step further comprises providing said liner assembly including said valve portion having an axially extending tubular member with internal and external surfaces, opposite ends sealingly interconnectable into said liner assembly, an opening extending radially between said internal and external surfaces, and a flow passage extending axially between said opposite ends, said flow passage being in fluid communication with the liner assembly interior bore, a tubular sleeve coaxially and slidably engaging said tubular member and having first and second seals disposed thereon, said first seal being disposed on a first diameter formed on said sleeve and said second seal being disposed on a second diameter formed on said sleeve, said second diameter being larger than said first diameter and being axially spaced apart therefrom, and said sleeve having a closed position wherein said first and second seals axially straddle said tubular member opening and an open position wherein one of said first and second seals is axially intermediate said opening and the other of said first and second seals, and said first screen being coaxially attached to said tubular member and being disposed relative to said opening, such that flow from the wellbore to the liner assembly interior bore through said opening must pass through said first screen.

26. A method of completing a subterranean well intersecting a formation, the method comprising the steps of:

providing a liner assembly including a first sand control screen;

disposing said liner assembly in the well, said first sand control screen being disposed opposite the formation;

providing an axially elongated tubular mandrel having an axially extending internal flow passage formed therethrough, an external side surface, and a port permitting fluid communication between said flow passage and said external side surface;

interconnecting said mandrel into said liner assembly;

providing an axially elongated tubular housing having an internal side surface and opposite ends;

forming an annular space radially intermediate said mandrel external side surface and said housing internal side surface by disposing said housing radially outwardly overlying and radially spaced apart from said mandrel;

sealingly attaching one of said housing opposite ends to said mandrel external side surface;

providing a tubular sleeve having internal and external side surfaces and opposite ends;

coaxially and slidably disposing said sleeve on said mandrel, one of said sleeve opposite ends being radially intermediate said mandrel external side surface and said housing internal side surface and further being received in said annular space;

disposing a first seal on said sleeve external side surface and sealingly engaging said housing internal side surface;

disposing a second seal on said sleeve internal side surface axially spaced apart from said first seal, said second seal sealingly engaging said mandrel external side surface;

providing a second tubular screen having opposite ends;

coaxially and slidably disposing said second screen on said mandrel; and attaching said second screen to said sleeve for sliding displacement therewith relative to said mandrel.

27. The method according to claim 26, wherein said screen disposing step further comprises radially outwardly disposing said sleeve relative to said mandrel external surface, and wherein said second screen attaching step further comprises attaching one of said second screen opposite ends to the other of said sleeve opposite ends.

28. The method according to claim 27, further comprising the steps of:

disposing a third seal on the other of said second screen opposite ends; and sealingly engaging said third seal with said mandrel external side surface.

29. The method according to claim 28, wherein said sleeve disposing step further comprises disposing said sleeve such that said sleeve has a closed position wherein said port is axially intermediate said first and second seals, and an open position, axially displaced from said closed position, wherein said port is axially intermediate said second and third seals.

30. The method according to claim 29, further comprising the steps of:

providing a frangible member;

releasably securing said sleeve in said closed position with said frangible member; and releasing said sleeve for displacement to said open position when a predetermined differential pressure is applied across said sleeve.

31. The method according to claim 26, further comprising the step of forming an opening radially through said mandrel, said opening permitting fluid communication between said internal flow passage and said annular space axially intermediate said one of said sleeve opposite ends and said one of said housing opposite ends.

32. A method of completing a subterranean well intersecting a formation, the method comprising the steps of:

providing a liner assembly including a first sand control screen;

disposing said liner assembly in the well, said first sand control screen being disposed opposite the formation;

providing a first tubular member having interior and exterior side surfaces, and further having a radially extending port formed therethrough permitting fluid communication between said first tubular member interior and exterior side surfaces;

connecting said first tubular member to said liner assembly;

providing a second tubular screen having opposite ends;

exteriorly and coaxially disposing said second screen relative to said first tubular member, said second screen radially outwardly overlying said port;

sealingly attaching said second screen to said first tubular member exterior side surface, said second screen opposite ends axially straddling said port;

providing a tubular sleeve, said sleeve having first and second exterior surfaces formed thereon and first and second seals disposed on said sleeve first and second exterior surfaces, respectively;

interiorly and coaxially disposing said sleeve relative to said first tubular member; sealingly engaging said first seal with said first tubular member interior side surface; and slidably and axially displacing said sleeve from a closed position to an open position thereof.

33. The method according to claim 32, further comprising the steps of:

providing a frangible member;

releasably securing said sleeve in said closed position with said frangible member; and releasing said sleeve for displacement relative to said first tubular member when a predetermined differential pressure is applied across said sleeve.

34. The method according to claim 32, wherein said sleeve providing step further comprises providing said sleeve having a second exterior surface radially enlarged relative to said sleeve first exterior surface.

35. The method according to claim 34, further comprising the steps of:

providing a second tubular member having an interior side surface;

coaxially attaching said second tubular member to said first tubular member and extending outwardly therefrom; and sealingly engaging said second seal with said second tubular member interior side surface.

36. The method according to claim 32, wherein said sleeve providing step further comprises providing said sleeve having an interior side surface and a shifting profile formed on said sleeve interior side surface.

37. The method according to claim 32, wherein said first tubular member providing step further comprises providing said sleeve having said port disposed axially intermediate said first and second seals, and wherein said sleeve disposing step further comprises disposing said sleeve radially inwardly overlying said port when said sleeve is in said closed position.

38. A method of gravel packing a subterranean well, said well having a wellbore intersecting a formation and a packer set in the wellbore, the method comprising the steps of:

providing a tubular liner assembly, said liner assembly including an interior bore, a radially extending flow port, and axially interconnected first and second elongated screens;

attaching said liner assembly to the packer;

positioning said liner assembly in said wellbore such that said second screen is opposite said formation;

providing a service tool string, said service tool string including a crossover portion, a nonreciprocating valve portion, and a washpipe portion, said valve portion being operative to permit flow through said first screen when a predetermined pressure differential is applied across said valve portion; and inserting said service tool string axially into said liner assembly.

39. The method according to claim 38, wherein said liner assembly providing step further comprises providing said liner assembly including first and second internal seal bores, axially interconnecting said first internal seal bore intermediate said flow port and said valve portion, and axially interconnecting said second internal seal bore intermediate said first and second screens, wherein said service tool string providing step further comprises providing said service tool string having first and second external seals disposed thereon, disposing said first external seal axially intermediate said crossover portion and said washpipe portion, and disposing said second external seal on said washpipe portion, and wherein said inserting step further comprises sealingly engaging said first external seal in said first internal seal bore and sealingly engaging said second external seal in said second internal seal bore.

40. The method according to claim 39, further comprising the steps of:

flowing a slurry through said crossover portion, outwardly through said flow port, and into said wellbore radially intermediate said liner assembly and said formation;

flowing a fluid portion of the slurry inwardly through said second screen and into said interior bore within said liner assembly; and creating a differential pressure across said liner assembly.

41. The method according to claim 40, further comprising the steps of:

increasing said differential pressure across said valve portion to said predetermined differential pressure;

opening said valve portion in response to said increasing step to thereby decrease said differential pressure below said predetermined differential pressure; and maintaining said valve portion open when said differential pressure decreases below said predetermined differential pressure after said opening step.

* * * * *